US008613255B1

(12) United States Patent
Chow

(10) Patent No.: US 8,613,255 B1
(45) Date of Patent: Dec. 24, 2013

(54) MONORAIL TRANSPORT SYSTEM

(71) Applicant: Brian Justin Chow, Arcadia, CA (US)

(72) Inventor: Brian Justin Chow, Arcadia, CA (US)

( * ) Notice: Subject to any disclaimer, the term of this patent is extended or adjusted under 35 U.S.C. 154(b) by 0 days.

(21) Appl. No.: 13/651,056

(22) Filed: Oct. 12, 2012

(51) Int. Cl.
*B61B 13/04* (2006.01)

(52) U.S. Cl.
USPC ..... 104/120; 104/119; 104/145

(58) Field of Classification Search
USPC ..... 105/141, 144, 145, 146, 147, 150; 104/118–121
See application file for complete search history.

(56) References Cited

U.S. PATENT DOCUMENTS

| | | | | | |
|---|---|---|---|---|---|
| 1,846,021 | A | | 2/1932 | Bell | |
| 2,976,820 | A | | 3/1961 | Schaar | |
| 3,012,519 | A | * | 12/1961 | Bingham | 104/120 |
| 3,147,714 | A | * | 9/1964 | Appelt et al. | 105/145 |
| 3,168,875 | A | | 2/1965 | Reed | |
| 3,361,084 | A | * | 1/1968 | Ellzey | 105/150 |
| 3,548,122 | A | * | 12/1970 | Hay | 191/12 R |
| 3,838,648 | A | | 10/1974 | Dahlberg et al. | |
| 3,937,147 | A | | 2/1976 | Szent-Miklosy, Jr. | |
| 3,985,081 | A | | 10/1976 | Sullivan, II | |
| 4,089,270 | A | | 5/1978 | Blake | |
| 4,164,187 | A | * | 8/1979 | Kaufmann | 104/93 |
| 4,423,685 | A | * | 1/1984 | Kerckhoff | 105/150 |
| 4,503,778 | A | | 3/1985 | Wilson | |
| 5,074,220 | A | | 12/1991 | Peterson | |
| 5,108,052 | A | | 4/1992 | Malewicki et al. | |
| 5,235,917 | A | * | 8/1993 | Luck et al. | 104/119 |
| D358,697 | S | * | 5/1995 | Kawai | D34/29 |
| 5,934,198 | A | * | 8/1999 | Fraser | 105/144 |
| 7,798,068 | B2 | * | 9/2010 | Nishihara et al. | 104/172.4 |

* cited by examiner

*Primary Examiner* — Jason C Smith
(74) *Attorney, Agent, or Firm* — Patent Law & Venture Group; Gene Scott

(57) ABSTRACT

A mass transit monorail uses an I-beam rail structure having an upper flange portion spaced apart from a lower flange portion, the flange portions joined by a vertical web portion. A frame of a vehicle has a pair of supporting wheels contacting the rail on a first side at an intersection of the web portion with the lower flange portion. A third wheel contacts the upper flange portion on a second opposing side of the rail. The vehicle moves along the rails which form a semi-continuous in-line track. A plurality of such tracks are positioned in parallel to make up a transport corridor with plural right-of-ways where vehicles may move in opposite directions passing each other. The rails are flexible enough to enable a vehicle to move from one semi-continuous in-line track to an adjacent semi-continuous in-line track.

6 Claims, 4 Drawing Sheets

MONORAIL TRANSPORT SYSTEM

BACKGROUND

This disclosure relates to the field of rail transport and more particularly to a monorail transport system.

Many of the problems facing personal transportation today are due to the predominance of cars, which leads to automobile congestion and contributes to environmental damage. The environmental movement of the last decade has prompted a critical examination of the transportation systems in use and possible alternatives. With few exceptions, the automobile remains the popular choice for transportation in industrialized nations. Prominently, the effects of anthropogenic global warming are proceeding at a rate exceeding scientific projections of the last few years: climate scientists recommend that humanity's peak carbon output should be reached well before the year 2020. In high density urban traffic, there is life-threatening danger from chemical exhaust. The expansion of automobile markets in rapidly developing countries, particularly China and India poses a challenge to those suggesting change. While the goal of a peak carbon output before 2020 may or may not be fulfilled, the ethical path of action is to consider technologies which make the broadest impact on a fundamental level. The contemporary approach for personal and work-related travel is to apply the greater use of public transport including: buses, heavy and light rail, but clearly, the public prefers the personal automobile. The expansion of roadways to accommodate more cars has not been able to keep up with the growth of the car population in urban centers. More, and expanded roads is undesirable in terms of space, pollution, and reliability. Carpooling tends to be shunned. The advent of the electric car may provide environmental advantages, although this is questionable, but has little if any impact on vehicular congestion.

Clearly, a radical change in mass transit is necessary to carry more people in relative comfort and privacy, and with less environmental impact. One such approach is disclosed herein.

BRIEF SUMMARY AND OBJECTIVES

The present disclosure describes a light rail mass transportation system. A mass transit monorail uses an I-beam rail structure having an upper flange portion spaced apart from a lower flange portion, the flange portions joined by a vertical web portion. A frame of a vehicle has a pair of supporting wheels contacting the rail on a first side at an intersection of the web portion with the lower flange portion. A third wheel contacts the upper flange portion on a second opposing side of the rail. The vehicle moves along the rails which form a semi-continuous in-line track. A plurality of such tracks are positioned in parallel to make up a transport corridor with plural right-of-ways where vehicles may move in opposite directions passing each other. The rails are flexible enough to enable a vehicle to move from one semi-continuous in-line track to an adjacent semi-continuous in-line track.

The system provides personal and cargo transport on demand. A traveler may simply walk up to the nearest station platform, get his or her vehicle out of a locker, place it on a spur track, and begin travel.

A passenger on the system communicates a desired destination by wireless communication from vehicle to a control station and the best path is automatically computer selected and set.

Spacing between vehicles is maintained automatically by communication from the control station to a computer control set within the vehicle which regulates acceleration, braking and other functions. Track-side sensors identify the location of all vehicles in the system at all times in order to regulate traffic flow. A manual control system may be employed as an alternate.

Parallel tracks are provided with each track identified for a specific range of speed so that vehicles that are speed limited are held to an appropriate slow track while faster vehicles are automatically shuttled to faster tracks.

Movement between main-line right-of-way (ROW) tracks, sidings, spurs, and stations is accomplished by mechanical alignment of a track with an adjacent track. This is accomplished by lateral bending of one or both of the tracks associated with a transfer and the bending of tracks is accomplished by mechanical or other means.

Traffic capacity on the system is similar to a multilane freeway, and as a result the system is competitive with automobile travel with respect to speed and is far superior with respect to environmental impact, efficiency, safety, convenience and most other issues related to mass transit most predominantly the elimination of traffic congestion.

System infrastructure is inexpensive to build due to its light weight construction and light weight vehicles. The total cost of the system is a fraction of that for any comparible transport concept Environmental impact is low since there is no effect on air quality from the system and noise levels projected from the system are well below that of roads and freeways.

The details of one or more embodiments of these concepts are set forth in the accompanying drawings and the description below. Other features, objects, and advantages of these concepts will be apparent from the description and drawings, and from the claims.

BRIEF DESCRIPTION OF THE SEVERAL VIEWS OF THE DRAWING

Like reference symbols in the various drawings indicate like elements.

DETAILED DESCRIPTION

Figure 3:
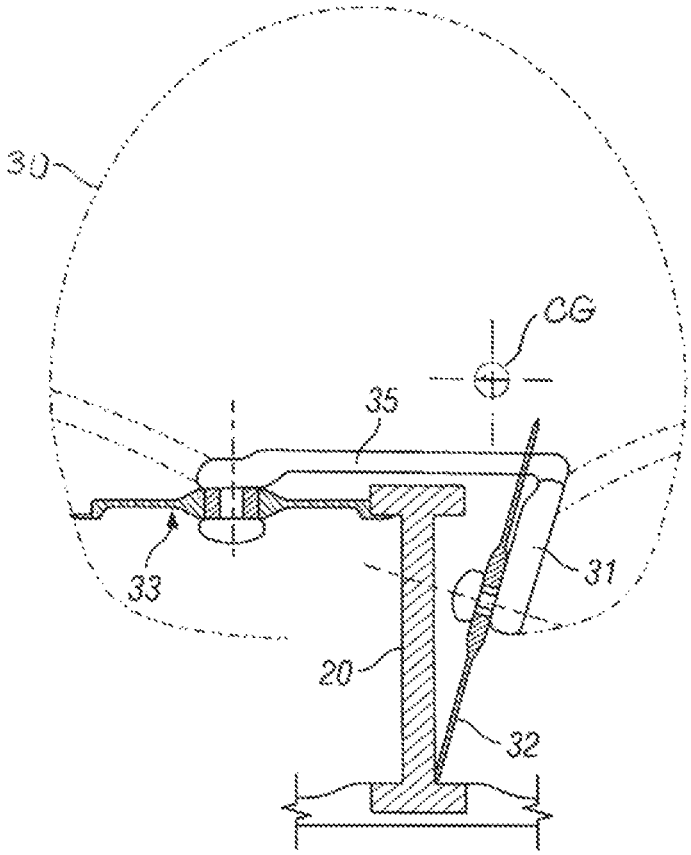
FIG. 3 is a cross-sectional view taken along line 3-3 in FIG. 2.
Figure 4:
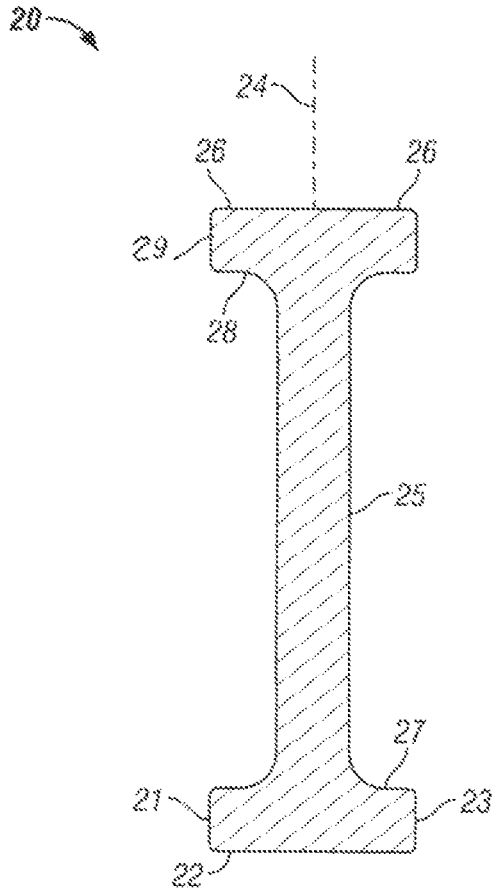
FIG. 4 an enlarged view of the track as shown in FIG. 3.
Figure 5:
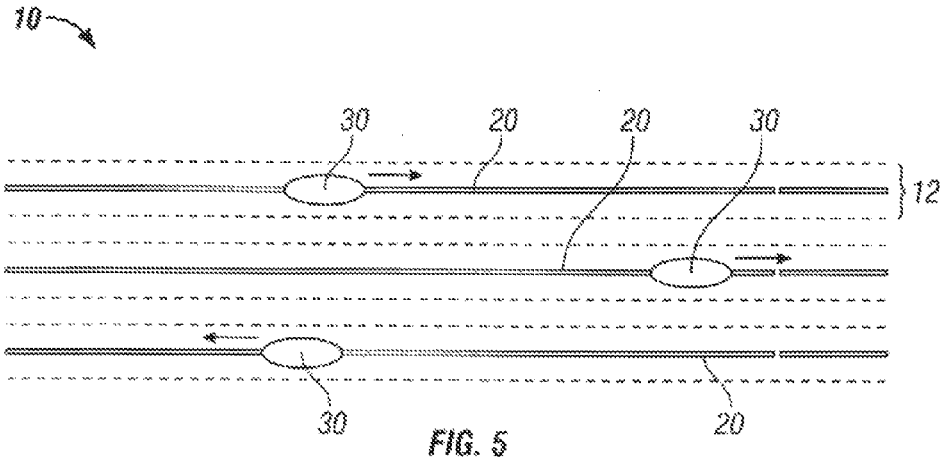
FIG. 5 is an example schematic plan view of a portion of the system showing plural tracks with vehicles traveling in two directions and indicating rights-of-way by dashed lines.
Figure 6:
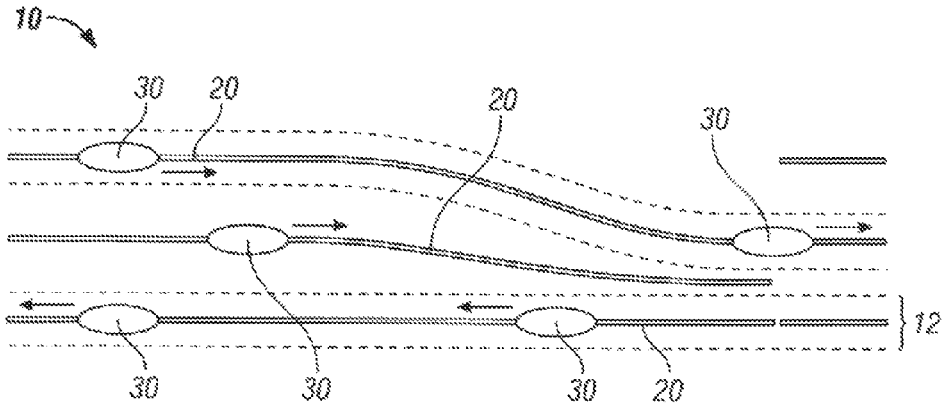
FIG. 6 is taken from FIG. 5 showing a method of vehicular track transfer.

An extreme light rail transport system 10 is disclosed herein and envisioned schematically in FIGS. 5 and 6. The system 10 operates using one or more tracks 20 forming traffic right-of-ways 12, shown by dashed lines, for vehicles 30 which are mounted on wheels 32 and 33 for rolling along tracks 20. Tracks 20 may be a steel I-beam as shown in FIG. 4 and may be designed to carry light loads with a limit, for instance, of about 50 pounds per lineal foot. The I-beam may have a top and bottom flange 26 joined by a vertical web 25. Track 20 may be mounted on, and anchored to, a supporting structure and secured thereto by surfaces 21, 22, and 23 of track 20 as shown in FIG. 3. Portions of tracks 20 are not fixed in place so that they are able to be pushed laterally for intertrack coupling as will be described below. Tracks 20 are configured so that they may allow for substantial bending in the horizontal plane; see FIGS. 5 and 6. Twisting and vertical bending are minimized by the geometry of tracks 20.

Figure 1:
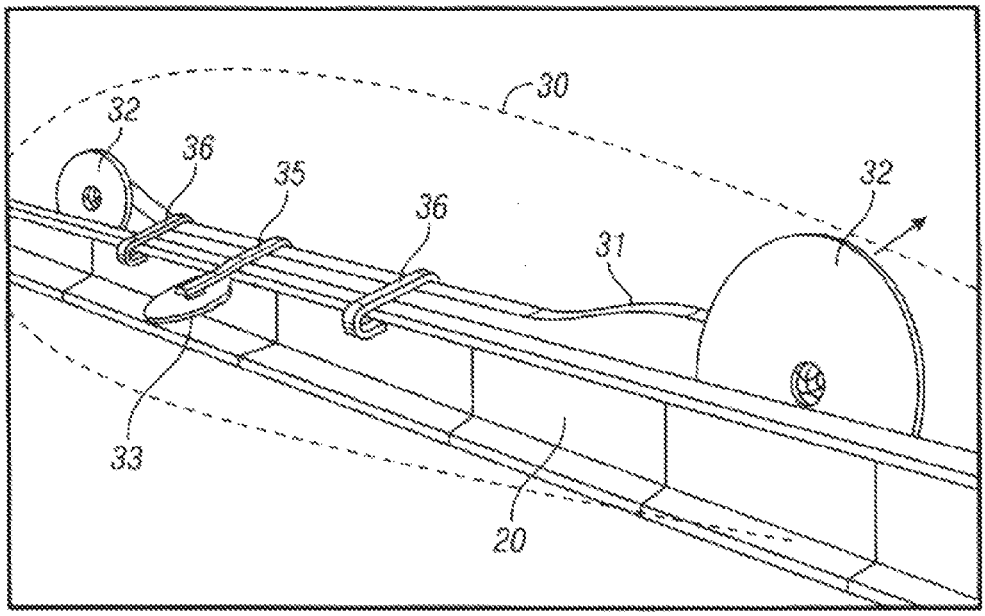
FIGS. 1 and 2 are example perspective views of an arrangement of a vehicle's frame and wheels as mounted on a track of the presently described system.
Figure 2:
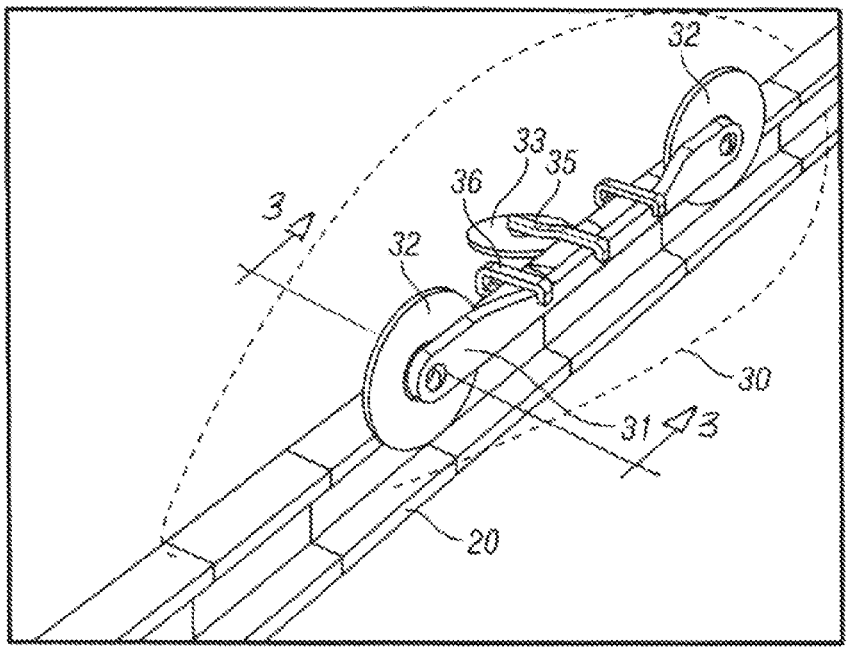

Vehicles 30, as illustrated by example in FIGS. 1 and 2, or other types of light weight vehicles may be used in system 10. Using the wheels arrangement shown in FIG. 3 vehicle 30 is mounted and stabilized on track 20. As shown supporting wheels 32 are mounted at opposing ends of frame 31 and are free to rotate. Wheels 32 are set at an angle off the vertical and roll on track 20 contacting it where web 25 and flange surface 27 meet (see FIG. 4). A third wheel 33 is secured by strut 35 in a position for rolling on track 20 contacting surfaces 28 and 29 (see FIG. 4). Wheel 33 contacts track 20 on the opposing side relative to wheels 32. The center of gravity CG of vehicle 30 is over the center of rotation of wheels 32 so that there is no possibility of the vehicle 30 tilting to the left in FIG. 3. This off center positioning of the CG is achieved by locating drive motors, batteries and other equipment predominantly on the right side of vehicle 30 as seen in FIG. 3, and of course, frame 31 is located on the right side of track 20 as well. For improved safety, small wheels (not shown) may be mounted on frame 31 in positions for contacting the right side of web 25 should vehicle 30 tend to tip to the left.

FIGS. 1-3 show by dished lines that vehicle 30 may have an aerodynamic fairing as an outer shell for minimizing wind resistance as vehicle 30 moves along track 20. Safety mechanisms such as hooks 36 may be employed to engage track 20 in case of track disengagement by third wheel 33. Hooks 36 may be an extension of frame 31 and may be positioned to grip flanges 26. Vehicles 30 may have a low silhouette for reduced air resistance and an occupant of vehicle 30 may assume a reclined or a supine position in order to allow for such a low silhouette. The vehicle 30 may be self-propelled by battery power driving one or more DC electric motors (not shown) engaged with one or both of wheels 32. Such propulsion arrangements are well known in the art.

Referring now to FIG. 5, three parallel tracks 20 are shown and vehicles 30 are shown by arrows, moving along tracks 20. An in-ground tractor (not shown) may be engaged with tracks 20 to move its end from a nominal alignment shown in FIG. 5 to an alternate merge alignment shown in FIG. 6 so that vehicle 30 is able to transfer from the top track 30 to the middle track 30 as shown. This movement of tracks 30 is possible since they are quite flexible in the horizontal plane yet quite stiff in the vertical direction. The lateral movement of a track 30 may only require 10-20 feet of track length so that track 30 may be free of attachment to a substructure only over that distance but may still rest on the substructure.

Rail stations in system 10 may have a number of shoulder or spur tracks 20 to serve both embarking and disembarking vehicles 30. Vehicles 30 for use on system 10 may be of such light weight as to be able to be picked up and moved onto and off of track 20 by hand or with a modest lifting device. Vehicles 30 are preferably sized for accommodating only one or two passengers. It is by this means that both track and vehicle may be of very light weight construction and this implementation provides for the highly economic advantage of system 10 over conventional mass transport systems.

It is anticipated that vehicles 30, may travel at typical speeds of about 30-40 miles per hour. The spacing and speeds of vehicles 30 may be determined from wayside sensors positioned at regular intervals along track 20. Such sensors, and the automated system that it enables is the reason that system 10 is safe in its use and implementation although able to carry a sizable traffic flow. Computer controlled traffic at junctures and merge points enables smooth and safe commuting. Thus, vehicles 30 are able to pass one-another by merging onto faster tracks. Merging also allows for vehicles 30 to move along a desired route. Each track's ROW may be about 48 inches wide, including the cushion space between tracks 20. The space occupied by a two-lane road would therefore hold four tracks 20 providing system 10 to handle double the vehicular flow capacity of typical roadways. System 10 may be capable of achieving over 100,000 vehicles 30 per day in a four-track arrangement. A typical contemporary freeway has 3-8 lanes per direction, which is equivalent to 6-16 tracks 20. Generally, the light weight structure of system 10 allows for the possibility of double or triple decking so that system 10 may be capable of handling a multiple of the maximum traffic in contemporary mass transit systems using automobiles and buses.

Embodiments of the subject apparatus and method have been described herein. Nevertheless, it will be understood that various modifications may be made without departing from the spirit and understanding of this disclosure. Accordingly, other embodiments and approaches are within the scope of the following claims.

What is claimed is:

1. A mass transit system comprising:

an I-beam rail having an upper flange portion spaced apart from a lower flange portion, the flange portions joined by a vertical web portion;

a frame of a vehicle, the frame engaged with at least two supporting wheels, the supporting wheels contacting a first side of the rail on the lower flange portion, the supporting wheels set at a near vertical angle spaced apart from the upper flange portion, the frame of the vehicle further engaged with at least one third wheel, the third wheel in contact with a vertical side surface, and a horizontal surface, of the upper flange portion on a second side of the rail; and a center of gravity of the vehicle positioned over centers of rotation of the supporting wheels.

2. The system of claim 1 wherein the rail is one of a plurality of rails, the rails positioned end-to-end as a first continuous rail arrangement.

3. The system of claim 2 wherein the first continuous rail arrangement is positioned in parallel alignment with a second, laterally positioned, continuous rail arrangement spaced apart from the first continuous rail arrangement for enabling vehicles moving on the two rail arrangements to pass each other.

4. The system of claim 3 wherein the rails are characterized by a flexibility in a horizontal plane wherein an end of a rail of the first continuous rail arrangement is flexibly positionable into a positioned adjacent an end of a rail of the second continuous rail arrangement; whereby vehicles moving on the rail arrangements are able to transfer therebetween.

5. A mass transit vehicle comprising:

in a vehicle frame of the vehicle, a pair of vehicle frame supporting wheels, the supporting wheels in contact with a lower end of an I-beam rail and positioned on one side of the I-beam rail, the supporting wheels set at a near vertical orientation spaced apart from an upper end of the I-beam rail;

at least one third wheel of the vehicle frame, the third wheel in contact with two adjacent surfaces of the upper end of the I-beam rail on a second side of the I-beam rail.

6. The system of claim 5 wherein a center of gravity of the vehicle is positioned over the centers of rotation of the supporting wheels.

* * * * *